US006244572B1

(12) United States Patent
Delsole

(10) Patent No.: US 6,244,572 B1
(45) Date of Patent: Jun. 12, 2001

(54) CARBURETOR FLOAT BOWL DRAIN SCREW AND RECOVERY SYSTEM

(76) Inventor: Robert Delsole, 86 Valley Rd., Larchmont, NY (US) 10538

( * ) Notice: Subject to any disclaimer, the term of this patent is extended or adjusted under 35 U.S.C. 154(b) by 0 days.

(21) Appl. No.: 09/413,910

(22) Filed: Oct. 4, 1999

Related U.S. Application Data

(60) Provisional application No. 60/103,133, filed on Oct. 5, 1998.

(51) Int. Cl.[7] ..... F02M 17/36

(52) U.S. Cl. ..... 261/38; 141/364; 222/552; 251/216; 261/72.1

(58) Field of Search ..... 261/38, 71, 2, 261/72.1, DIG. 21, DIG. 38, DIG. 67; 141/364; 222/110, 489, 390, 552, 568; 251/216; 184/106

(56) References Cited

U.S. PATENT DOCUMENTS 1,625,572 * 4/1927 Simpson ..... 261/72.1 X
1,734,232 * 11/1929 Ryan et al. ..... 222/552
1,859,126 * 5/1932 Boeuf ..... 222/552
3,184,091 * 5/1965 Hoffman ..... 222/552 X
4,986,502 * 1/1991 Ceroke ..... 251/216
5,368,181 * 11/1994 Myers ..... 251/216 X
5,653,270 * 8/1997 Burrows ..... 141/364 X

* cited by examiner

*Primary Examiner*—Richard L. Chiesa
(74) *Attorney, Agent, or Firm*—Richard A. Joel, Esq

(57) ABSTRACT

A carburetor float bowl drain screw and recovery system includes a retaining screw having a threaded forward end, an intermediate portion having a plurality of transverse holes leading to an axial channel and an internally threaded end portion terminating in a hex head. An externally threaded insert engages the end portion and includes a tapered forward portion which engages tapered internal walls on the retaining screw to effect a seal, an internal channel and a hexagonal rear portion terminating in a cylindrical end for coupling a fuel line thereto. When the insert is loosened fuel flows through the holes in the screw into the screw channel and then outwardly through the insert channel to a fuel line. The fuel bowl may thus be safely drained.

6 Claims, 2 Drawing Sheets

CARBURETOR FLOAT BOWL DRAIN SCREW AND RECOVERY SYSTEM

CROSS-REFERENCE TO RELATED APPLICATIONS

This patent application is related to Provisional Application 60/103,133 filed Oct. 5, 1998.

STATEMENT REGARDING FEDERALLY SPONSORED RESEARCH OR DEVELOPMENT

Research and development of the present invention and application have not been Federally sponsored, and no rights are given under any Federal program

BACKGROUND OF THE INVENTION

FIELD OF THE INVENTION

This invention relates to carburetors and particularly to a carburetor float bowl drain screw and recovery system to facilitate service and to protect the environment by safely draining fuel from a carburetor.

DESCRIPTION OF THE RELATED ART INCLUDING INFORMATION DISCLOSED UNDER 37 CFR §§1.97–1.98

The prior art includes traditional carburetors particularly of the Holley-type. In order to perform service on the carburetor it is necessary to drain the fuel therefrom. This can be a time consuming and risky job since the fuel cannot be allowed to come in contact with the hot engine. These problems are eliminated which proposes a retaining screw and drain screw all in one by the present invention. Furthermore, the fuel that was contained in the previous carburetor designs was discarded causing environmental concerns. The present invention permits reuse of the fuel.

SUMMARY OF THE INVENTION

The invention relates to a carburetor float bowl drain screw and recovery system which permits fuel to be safely drained from a carburetor for servicing purposes. The unique screw assembly is inserted into the float bowl and permits fuel to be drained outwardly into a container through channels in the screw. The screw includes a threaded forward end to retain the bowl in position, an intermediate portion having a channel which extends outwardly through an exterior portion terminating in a hollow hex head.

An insert is threaded into the threaded hollow portion of the retaining screw and includes a tapered forward portion which effects a seal with a mating internal portion of the screw. The insert also includes a channel through which the fuel flows when the rear hex head portion of said insert is loosened. The fuel flows outwardly through a slip end over which a rubber hose is positioned.

Accordingly, an object of this invention is to provide a new and improved float bowl drain screw for carburetors.

Another object of this invention is to provide a new and improved means to drain and recapture fuel from carburetors so that servicing can take place safely.

A further object of this invention is to provide a drain screw and retaining assembly of a unique nature which permit fuel to be safely drained from a carburetor float bowl into a container for recovery purposes.

A more specific object of this invention is to provide a unique screw drain which includes a channel extending into the float bowl and an outer portion which sealingly fastens against the outer wall of the bowl and an insert which threadingly engages the screw drain to control the flow from the channel.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 4:
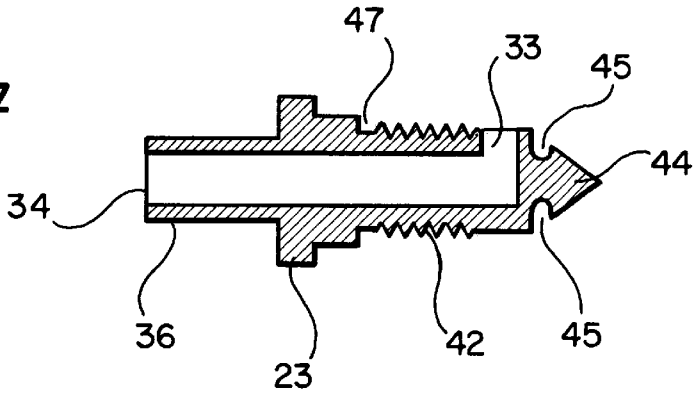
FIG. 4 is a cross-sectional view of the threaded insert for the drain screw.
Figure 1:
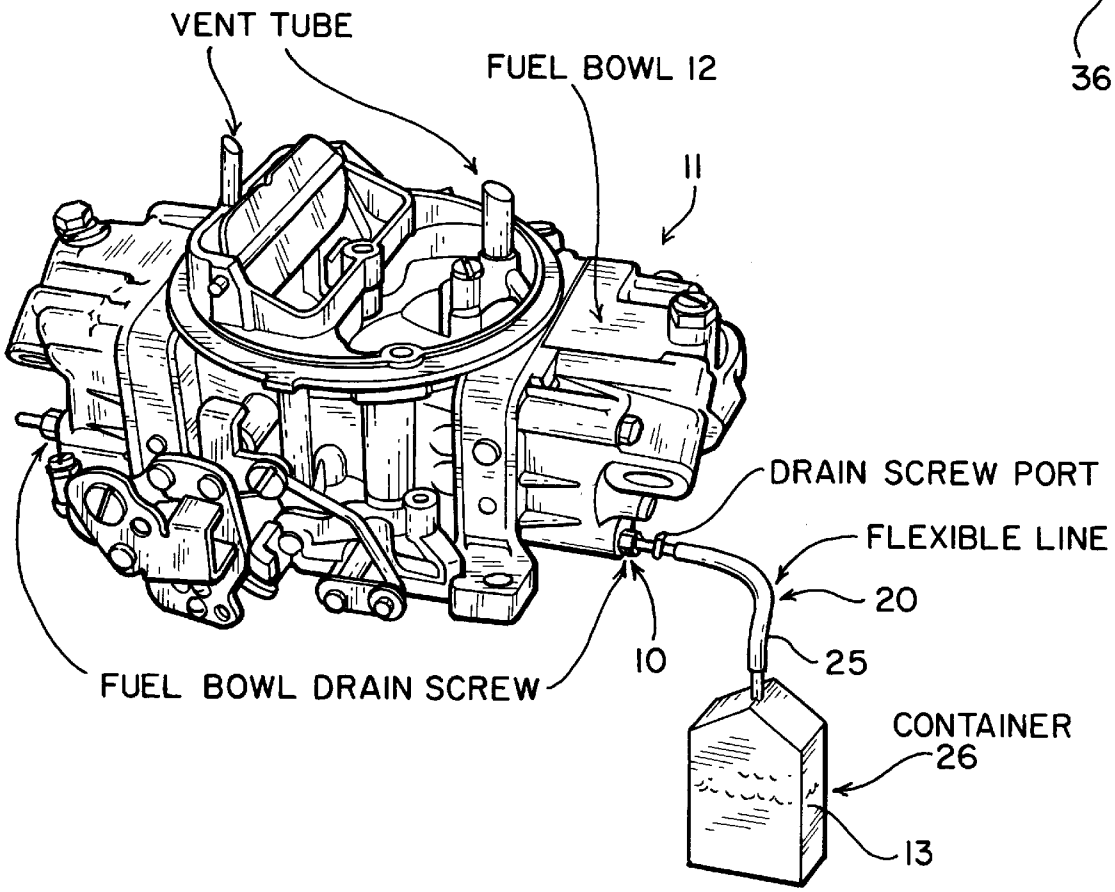
FIG. 1 is a perspective view of a carburetor showing the invention incorporated therein.
Figure 3:
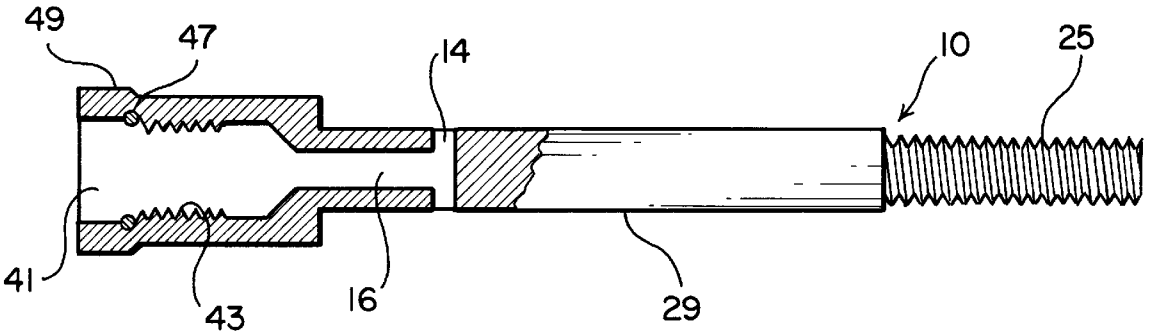
FIG. 3 is a partial cross-sectional view of a fuel bowl drain screw.
Figure 2:
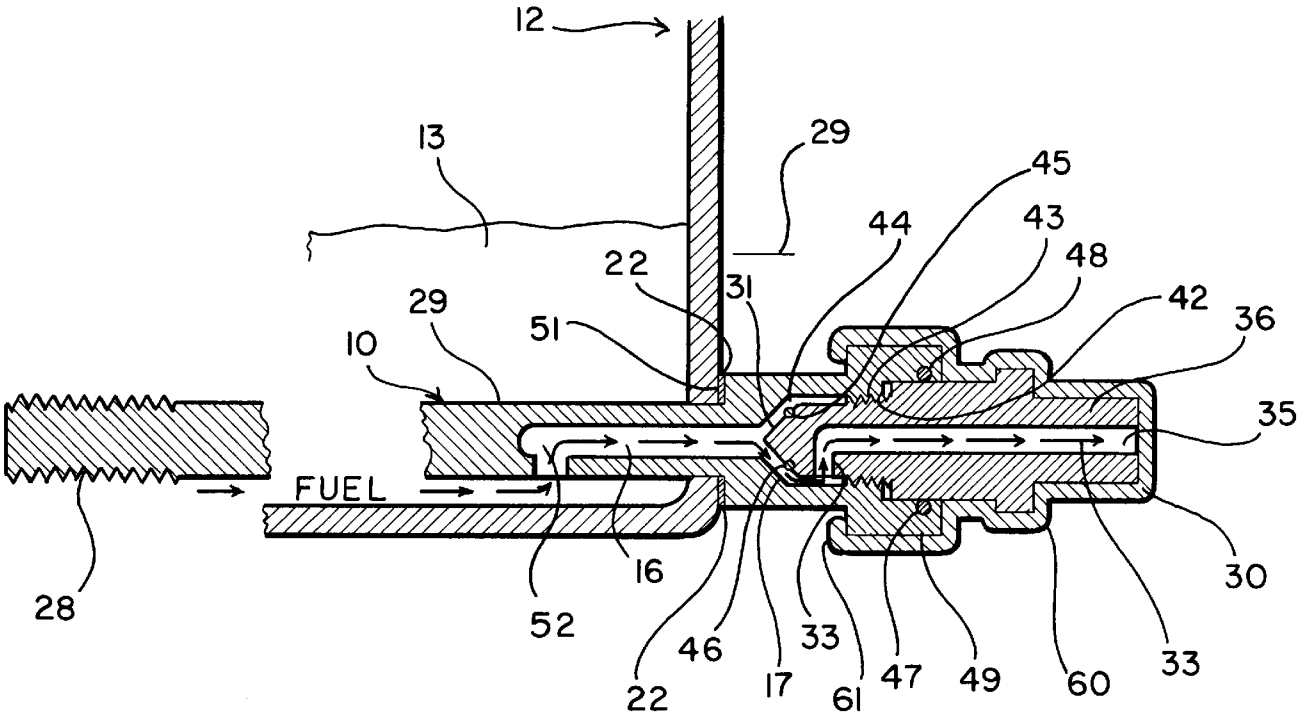
FIG. 2 is a partial cross-sectional view of the invention in combination with a carburetor float bowl.

Referring now to the drawings, the invention comprises a fuel bowl drain screw 10 and recovery system 20. The drain screw 10 permits fuel 13 to be safely drained from a carburetor 11 so that the bowl 12 can be removed permitting work to be performed on jets, metering blocks, floats, and other parts of the carburetor 11. The invention promotes safety and answers environmental concerns by permitting the fuel 13 to be collected in a container 26 and reused.

The fuel float bowl 12 is mounted within a conventional carburetor 11 by means of a unique drain and retaining screw 10 which includes a threaded forward end 28 and an intermediate portion 29 having three equi-spaced transverse holes 14 which permit fuel 13 to enter into the longitudinal channel 16. The drain screw 10 includes a hex head 19 at the rear end thereof for tightening the screw 10 against a gasket 22 which engages the outer wall 29 of the fuel bowl 12.

A drain element or insert 30 is threadingly mounted within the hollow end 41 of the screw 10. The threads 42 on element 30 mesh with internal threads 43 on the screw 10. The element 30 also includes a tapered forward end 44 having a recess 45 for a gasket or O-ring 46 and a similar recess 47 adjacent the screw threads 42 to accommodate gasket 48. The gaskets 46 engage tapered walls 31 to effect a tight seal when the hex head 23 is tightened. The drain element 30 also includes a transverse channel 33 extending inwardly from its outer wall to a connecting central channel 35 which leads to an exit aperture 34. The extreme rear portion of the element 30 includes a cylindrical exit portion 36 onto which a flexible line is mounted. A flexible rubber or plastic cover 60 is fitted over the insert 30 and screw 10 to keep dirt out of the fuel port 35 and to prevent the insert 30 from loosening up. The cover 60 includes inwardly extending portions 61 which grip the screw 10 while the cover 60 is fitted in engagement with the insert 30 and screw 10.

In operation, the flexible screw 10 is inserted through the float bowl 12 and tightened with the hex head 49 so that the wall 51 engages gasket 22 against the outer wall 29 of the bowl 12. The drain valve or element 30 is then tightened within the screw 10 sealing the channel 16. The cover 60 is then snapped in place. When it is desired to remove the bowl 12, the cover is removed and a flexible line 25 is inserted over the slip end 36 and the element 30 loosened by gripping the hex head 23. The seal 26 moves outwardly opening the channel 17 so that fuel 13 flows into the channel 33 in the drain value 30 and then outwardly through exit aperture 35 into the container 26. Three equally spaced holes 52 in the screw 10 permit fuel 13 to flow into the channel 16 and when the insert 30 is loosened about the tapered face 46 into channels 33 and 36. The fuel 13 then flows outwardly through line 25 into container 26. The carburetor, empty of fuel, may then be safely worked on.

While the invention has been explained by a detailed description of certain specific embodiments, it is understood that various modifications and substitutions can be made in any of them within the scope of the appended claims which are intended also to include equivalents of such embodiments.

What is claimed, is:

1. A carburetor float bowl drain screw and recovery system for fuel comprises:

a drain screw comprising a threaded forward portion for coupling to a carburetor, an intermediate portion having an axial channel, an outer wall and a plurality of transverse holes extending from the outer wall to the channel, and a hollow rear portion having an internally threaded aperture leading to the axial channel, a forward tapered internal portion on said aperture and an enlarged outer portion including a hex head;

a hollow insert having a tapered forward portion to engage the tapered internal screw wall, an intermediate threaded outer wall to engage the internal screw threads, a hex nut portion and a cylindrical outer portion having an outlet aperture;

wherein said insert can be loosed to permit fuel to flow from the drain screw through the insert to the cylindrical outer portion outlet to permit recovery thereof.

2. A carburetor float bowl drain screw and recovery system for fuel in accordance with claim 1 wherein:

the rear portion includes a wall extending at right angles to the intermediate portion; and, a gasket mounted about the intermediate portion, said wall engaging the gasket against the carburetor for sealing purposes.

3. A carburetor float bowl drain screw and recovery system for fuel in accordance with claim 2 further including:

a circumferential recess adjacent the end of the tapered forward portion of the insert; and, a gasket mounted in said recess.

4. A carburetor float bowl drain screw and recovery system for fuel in accordance with claim 3 further including:

a circumferential recess in the outer wall adjacent the threads; and, a gasket mounted therein for sealing purposes.

5. A carburetor float bowl drain screw and recovery system for fuel in accordance with claim 1 wherein:

the transverse holes comprise three equally spaced holes leading to the channel.

6. A carburetor float bowl drain screw and recovery system for fuel in accordance with claim 1 wherein:

a flexible cover mounted over the insert and extending inwardly in engagement therewith to grasp the drain screw to protect the outlet aperture and to prevent the insert from loosening within the drain screw.

* * * * *